US005749757A

United States Patent [19]

Suganuma

[11] Patent Number: 5,749,757

[45] Date of Patent: May 12, 1998

[54] IMPELLER SHAFT JOURNAL FOR JET PUMP

[75] Inventor: Noboru Suganuma, Hamamatsu, Japan

[73] Assignee: Sanshin Kogyo Kabushiki Kaisha, Shizouka-ken, Japan

[21] Appl. No.: 838,679

[22] Filed: Apr. 9, 1997

Related U.S. Application Data

[63] Continuation of Ser. No. 576,125, Dec. 21, 1995, abandoned.

[30] Foreign Application Priority Data

Dec. 26, 1994 [JP] Japan ..... 6-322271

[51] Int. Cl.[6] ..... B63H 11/02

[52] U.S. Cl. ..... 440/83; 384/215; 384/221; 440/112; 440/38

[58] Field of Search ..... 384/215, 220–222; 440/38, 47, 83, 82, 111, 112; 60/221, 222

[56] References Cited

U.S. PATENT DOCUMENTS

| | | | |
|---|---|---|---|
| 2,166,259 | 7/1939 | Meyer | 384/222 |
| 2,223,872 | 12/1940 | McWhorter et al. | 384/222 |
| 2,793,087 | 5/1957 | Hayes | 384/220 |
| 4,722,707 | 2/1988 | Murase | 440/83 |
| 4,765,758 | 8/1988 | O'Donnell et al. | 384/222 |
| 4,813,898 | 3/1989 | Nakase et al. | 440/38 |

*Primary Examiner*—Ed L. Swinehart

*Attorney, Agent, or Firm*—Knobbe, Martens, Olson & Bear LLP

[57] ABSTRACT

An elastic plane-bearing support for the impeller shaft of a water jet propulsion unit for providing good support and yet accommodating relative movement between the engine and the jet propulsion unit.

4 Claims, 7 Drawing Sheets

IMPELLER SHAFT JOURNAL FOR JET PUMP

CROSS-REFERENCE TO RELATED APPLICATION

This Application is a continuation of my Application of the same title, Ser. No. 08/576,125, filed Dec. 21, 1995, now abandoned.

BACKGROUND OF THE INVENTION

This invention relates to a jet propelled watercraft and more particularly to an improved impeller shaft journal and drive arrangement for the jet pump of such watercraft.

A very popular type of watercraft known as the "personal watercraft" is designed so as to be operated by a rider and only one or a few passengers. Frequently, this type of watercraft is propelled by a jet propulsion unit. The jet propulsion unit is comprised of a jet pump that is mounted in a tunnel at the rear of the watercraft and which has an impeller that functions to pump water and provide a propulsion force for the watercraft.

The impeller is connected to an impeller shaft that extends forwardly and which enters the engine compartment through a bulkhead formed at the rear of the engine compartment and at the front of the tunnel in which the jet propulsion unit is positioned. The impeller shaft is coupled to the engine output shaft so as to be driven by it. This coupling must provide a number of functions, which have resulted in somewhat complex and expensive configurations.

That is, it is important that the front of the impeller shaft be journaled so as to reduce wear and noise. Generally, a ball or roller type bearing is provided which has its inner race press-fitted around the forward end of the impeller shaft. Since the engine is resiliently mounted in the frame, the connection between the engine output shaft and the impeller shaft must accommodate some relative movement. Therefore, it has been the practice to provide some form of diaphragm support for the outer race of the impeller shaft journal.

In addition, in order to accommodate movement splined couplings are frequently employed between the impeller shaft and the engine output shaft. To facilitate ease of assembly and disassembly, these spline connections are frequently formed by intermediate shafts and thus the overall construction becomes quite complicated, expensive, and at times difficult to assemble and disassemble.

It is, therefore, a principal object of this invention to provide an improved drive arrangement for the impeller shaft of a jet propelled watercraft.

It is a further object of this invention to provide an improved and simplified arrangement for driving a jet propulsion unit impeller shaft and journaling the shaft so as to permit ease of assembly and disassembly and yet accommodate the relative movements which must be accounted for.

SUMMARY OF THE INVENTION

This invention is adapted to be embodied in a driving arrangement for the impeller of a water jet propulsion unit having an outer housing journaling an impeller. The outer housing has a tubular extending portion that extends forwardly to a point adjacent an engine output shaft. The impeller shaft for the jet propulsion unit extends through this tubular portion and is journaled therein by a plane bearing which plane bearing has a resilient support relative to the tubular extension.

DETAILED DESCRIPTION OF THE PREFERRED EMBODIMENTS OF THE INVENTION

Figure 1:
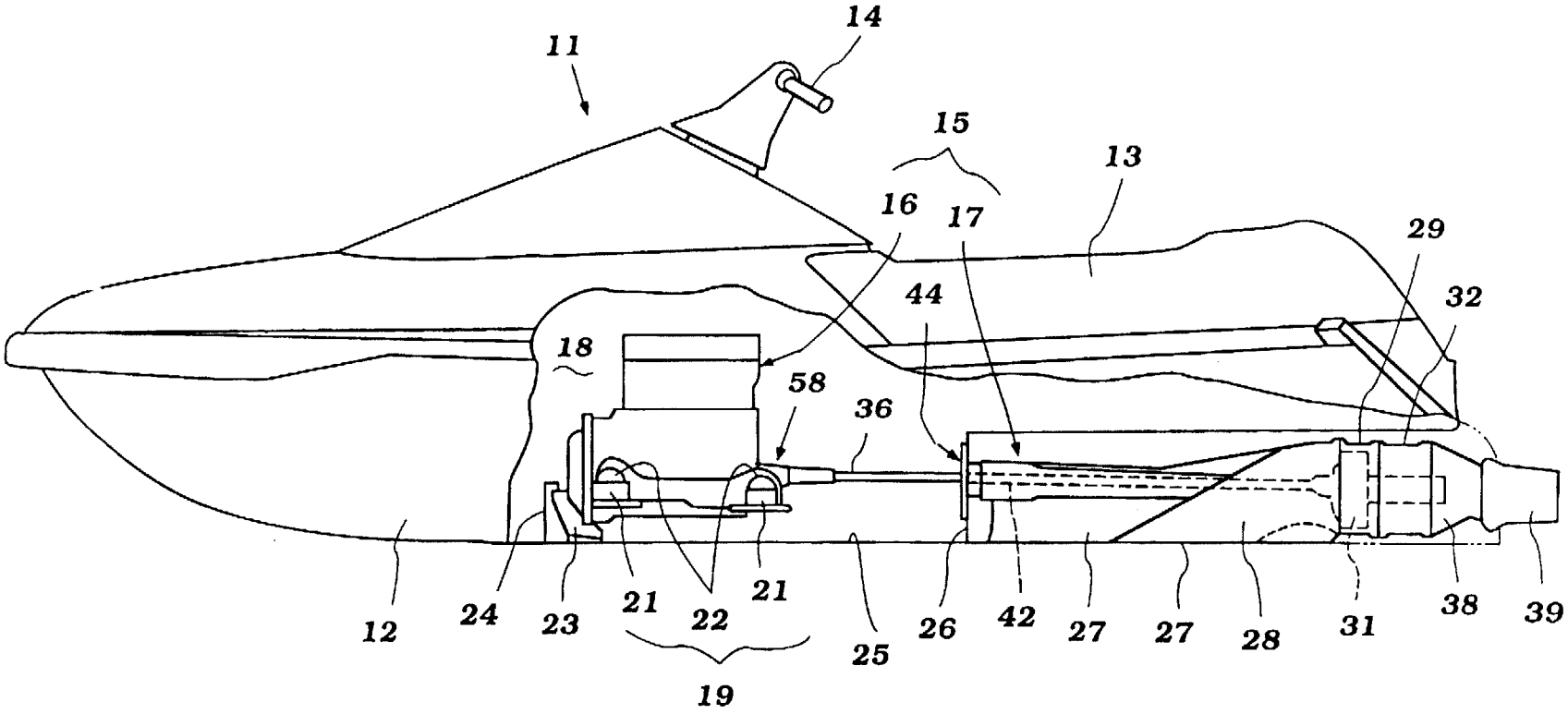
FIG. 1 is a side elevational view of a jet propelled watercraft constructed in accordance with an embodiment of the invention, with a portion broken away so as to more clearly show the construction.

Referring now in detail to the drawings and initially to FIG. 1, a small personal watercraft constructed in accordance with an embodiment of the invention is shown an identified generally by the reference numeral 11. It is to be understood that although the invention is described in conjunction with a particular type of personal watercraft, that the invention is capable of use with a wide variety of types of watercraft including those other than personal watercraft. However, and for reasons which will become apparent, the invention has particular utility with such watercraft because they are frequently powered by jet propulsion units and certain facets of the invention has particular utility in conjunction with jet propelled watercraft.

The watercraft 11 is comprised of a hull 12 which may have any desired configuration and which is provided with a rider's area in which a raised straddle-type seat 13 is provided. On opposite sides of the seat 13 there are positioned foot areas where the rider and his passengers, who are seated in straddle, tandem fashion may place their feet during operation of the watercraft 11. Forwardly of the seat there is provided a control mast 14 including a handlebar assembly for control of the watercraft 11.

The watercraft 11 is powered by a propulsion system, indicated generally by the reference numeral 15 and which is comprised of an internal combustion engine 16 and a jet propulsion unit 17. The engine 16 may be of any known type and is depicted as being of the in-line, multiple cylinder type, although it will be readily apparent to those skilled in the art how the invention may be utilized with a wide variety of types of engines.

The engine 16 is mounted in an engine compartment 18 that is formed at the forward portion of the hull 12 and forwardly of and beneath the seat 13 and mast 14. The engine 16 is mounted within the engine compartment 18 on a mounting assembly, indicated generally by the reference numeral 19 which is comprised of front and rear resilient mounts 21 that are connected to the body of the engine 16 through a mounting cradle 22. This assembly is then mounted on a mounting block 23 and mounting assembly 24 provided at the front of the engine compartment 18 on a hull undersurface 25 in any suitable manner.

The rear end of the engine compartment 18 is defined by a bulkhead 26 which forms the forward portion of a tunnel 27 (FIG. 2) which contains the jet propulsion unit 17. This jet propulsion unit 17 is comprised of an outer housing assembly that consists of a downwardly facing water inlet portion 27 that defines a water inlet opening on the underside of the hull 12 and which may be formed in part by the hull itself.

Figure 3:
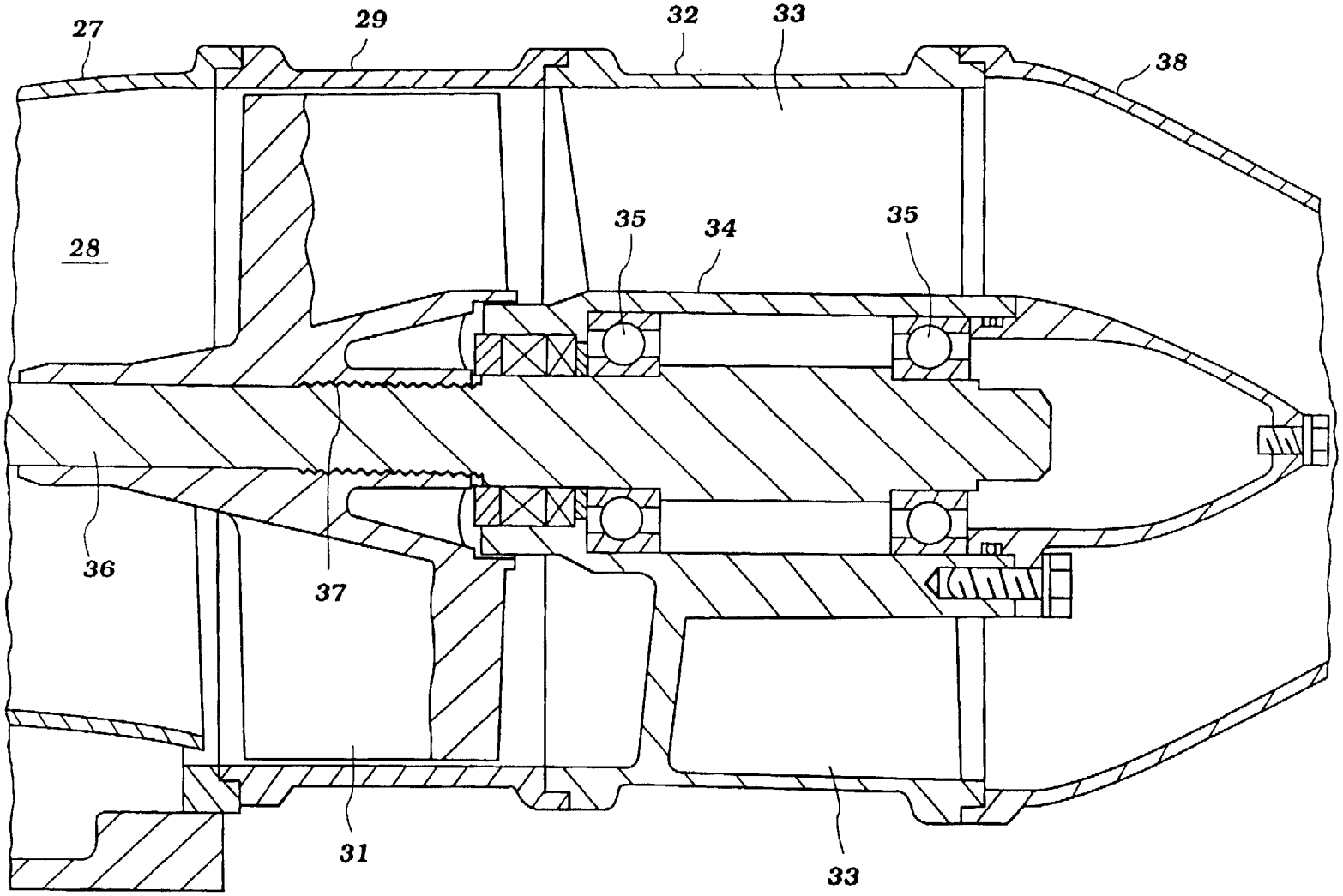
FIG. 3 is an enlarged cross-sectional view taken for the area to the rear of that shown in FIG. 2 and shows the connection between the impeller shaft and the impeller of the jet propulsion unit.

This water inlet opening 27 supplies a water inlet duct 28 that extends upwardly and rearwardly to an impeller housing 29 in which an impeller 31 is journaled in a manner best seen in FIG. 3. It will be seen that a cylindrical section 32 of the jet propulsion unit housing mates with the impeller portion 29 and provides a plurality of straightening vanes 33 which extend outwardly from a nacel 34. The nacel 34, in turn, provides a pair of anti-friction bearings 35 that rotatably journal the rear end of an impeller shaft 36. The impeller shaft 36, in turn, has a threaded connection 37 which is received in a female threaded opening of the impeller 31 for providing a rotational connection between the impeller shaft 36 and the impeller 31.

Rearwardly of the straightening vanes 33 there is provided a discharge nozzle portion 38 of the jet propulsion unit outer housing which discharge nozzle portion 38 is suitable connected to the straightening vane portion 32. As is typical in jet propulsion units for watercraft, a steering nozzle 39 is journaled for steering movement about a vertically extending steering axis by means of a pair of pivot pins (not shown). The steering nozzle 39 is coupled to the steering mast 14 for its steering movement in a manner well known in this art.

The water inlet forming portion 27 of the jet propulsion unit outer housing is provided with a tubular extension 41 which extends forwardly and which terminates at a bell-mouth section 42 (FIGS. 2 and 4) formed adjacent the rear end of the bulkhead 26. This bell-mouth portion 42 is telescopically received in a cylinder extension 43 of a front support piece, indicated generally by the reference numeral 44 and which has an outwardly extending flange 45 that is affixed in sealing relationship with the bulkhead 26 with an interposed O-ring seal 46.

It will be seen that the impeller shaft 36 extends forwardly through the tubular portion 41, its bell-mouth 42 and the sleeve 43 so as to penetrate into the engine compartment 18. The portion of the impeller shaft 36 forwardly of the water inlet passage 28 is provided with a sealing arrangement that is comprised of water seals 47, a support bearing 48 and a further elastic support 49.

Figure 2:
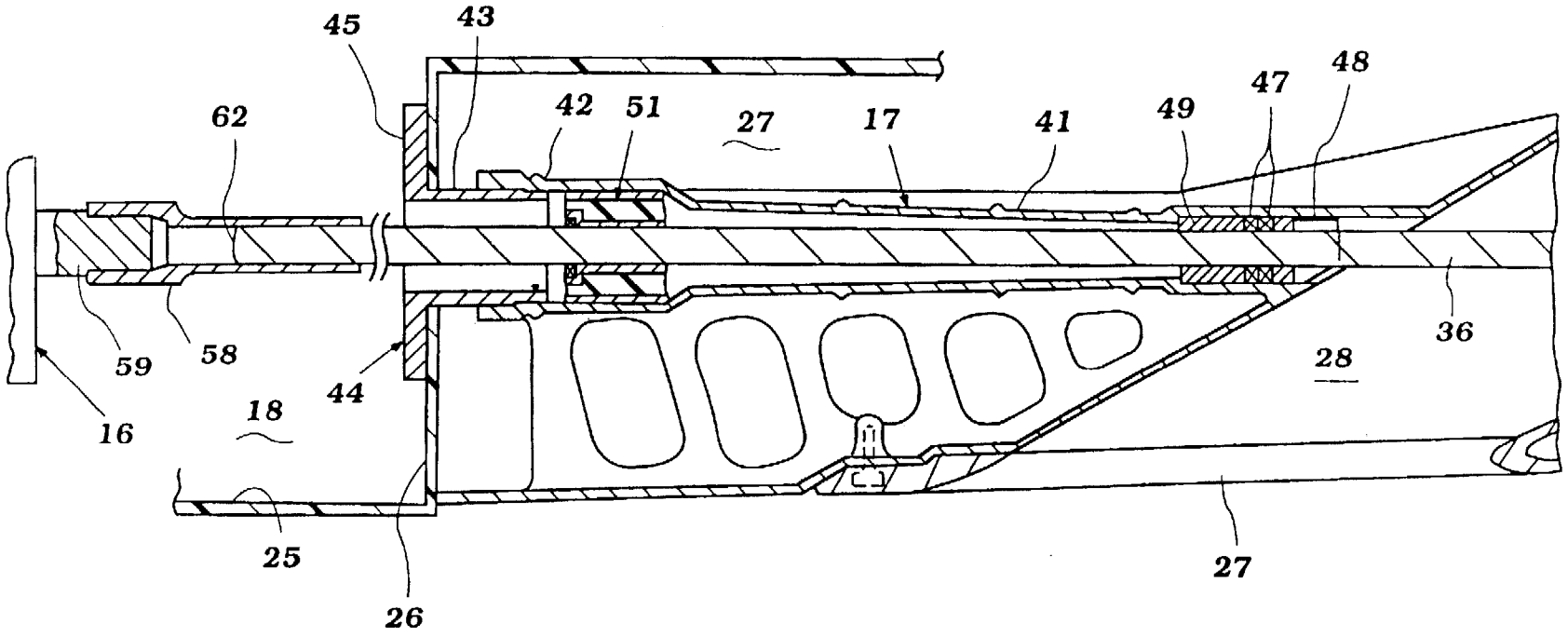
FIG. 2 is an enlarged cross-sectional view taken through the broken away portion shown in FIG. 1 and looking in the same general direction as FIG. 1.
Figure 4:
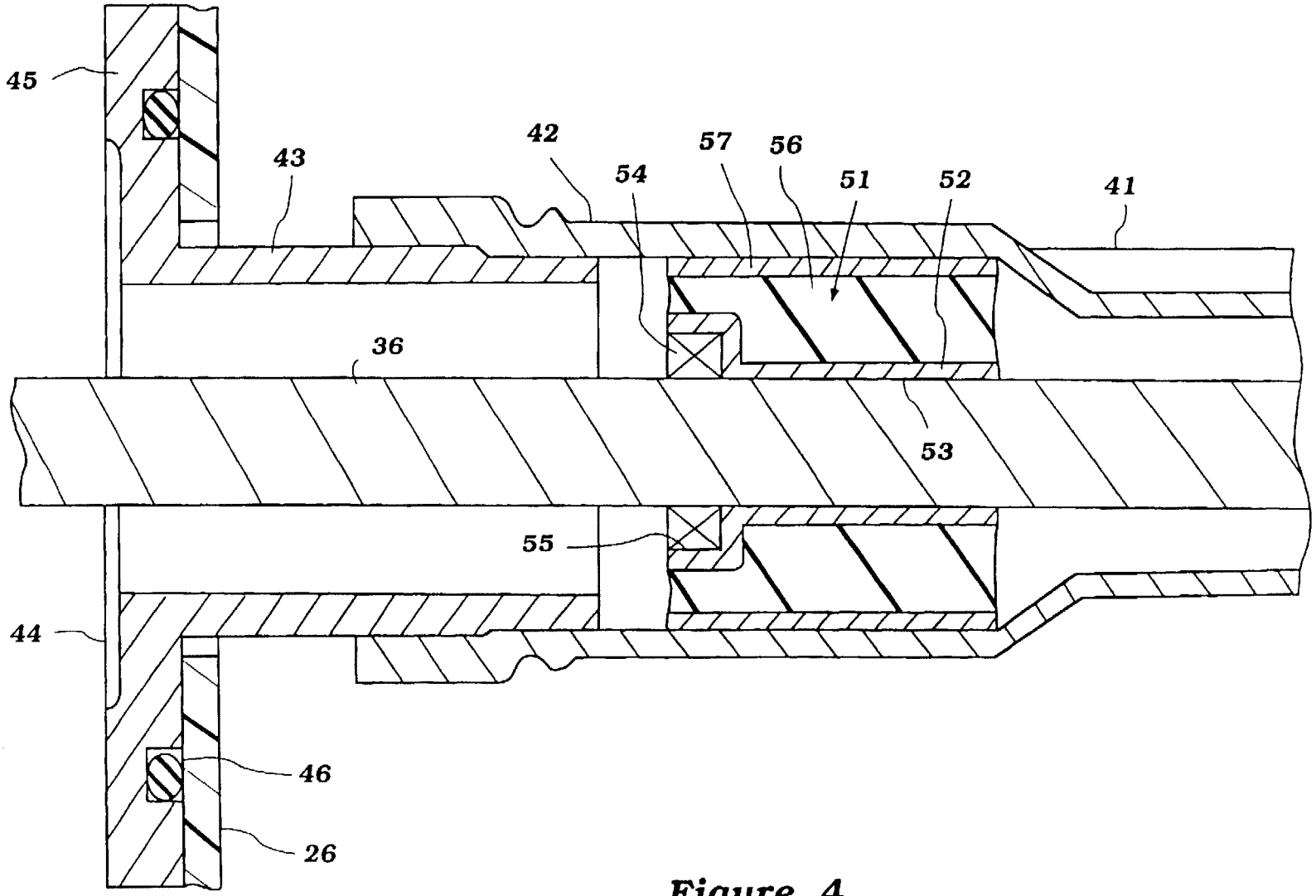
FIG. 4 is a further enlarged cross-sectional view of the forward portion of the jet propulsion unit and that portion shown in FIG. 2.
Figure 5:
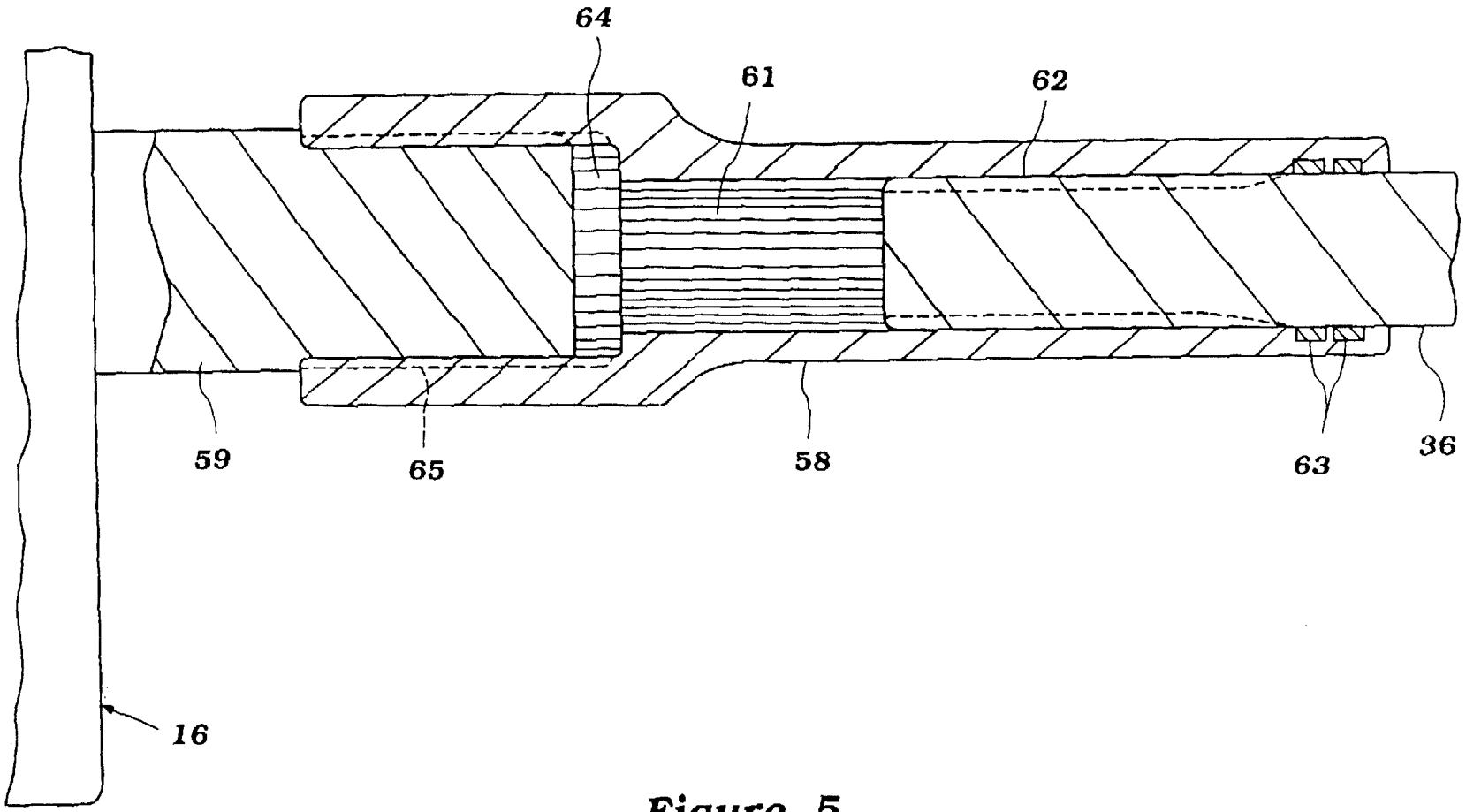
FIG. 5 is a cross-sectional view of the area immediately to the left of that shown in FIG. 4 on the same scale and also showing the same area as illustrated at the left-hand side of FIG. 2.

At the forward end and adjacent the bulkhead 26, a bearing arrangement, indicated generally by the reference numeral 51 and having a construction in accordance with the invention is provided. This bearing 51 has a construction that is best seen in FIGS. 2 and 4 and is comprised of a plane bearing member 52 that is formed from a suitable bearing material and has a cylindrical opening 53 that receives and journals the impeller shaft 36.

A seal 54 is provided in a bell-mouthed opening 55 at the forward end of the plane bearing 52 so as to provide a water-tight seal in this area. The plane bearing 53 is supported by an elastomeric sleeve 56, to which it may be affixed by bonding or vulcanizing. The elastomeric sleeve 56 is, in turn, bonded or vulcanized to a further sleeve 57 that is received in the bell-mouth portion 42 of the tubular extension 41 of the jet propulsion unit outer housing. As a result, the forward end of the impeller shaft 36 is rotatably journaled by the plane bearing 53 but is free to move transversely and follow movement of the engine 16 on its elastic supports 21 upon inertial loadings. That is, the sleeve 56 can deflect in a radial direction and accommodate this movement while, at the same time, maintaining a good bearing relationship.

In order to facilitate assembly and disassembly, a connector spline shaft, indicated generally by the reference numeral 58 is provided for providing a spline connection between the impeller shaft 36 and an engine output shaft 59. The connector spline 58 has a first female splined portion 61 that receives a male splined end 62 of the impeller shaft 36. A pair of seals 63 are received in grooves formed at one end of the spline member 58 so as to permit water-tight protection for the spline connection 61, 62. It will be seen that the spline portion 62 is of the same diameter as the main portion of the impeller shaft 36. As a result, the impeller shaft 36 may be easily withdrawn through the plane bearing member 52 and specifically its opening 53.

The spline connector 58 has a larger diameter female spline portion 64 that is received on a male splined portion 65 of the engine output shaft 59 so as to complete these splined connection and to permit axial movement and facilitate assembly and disassembly, as should be readily apparent.

Figure 6:
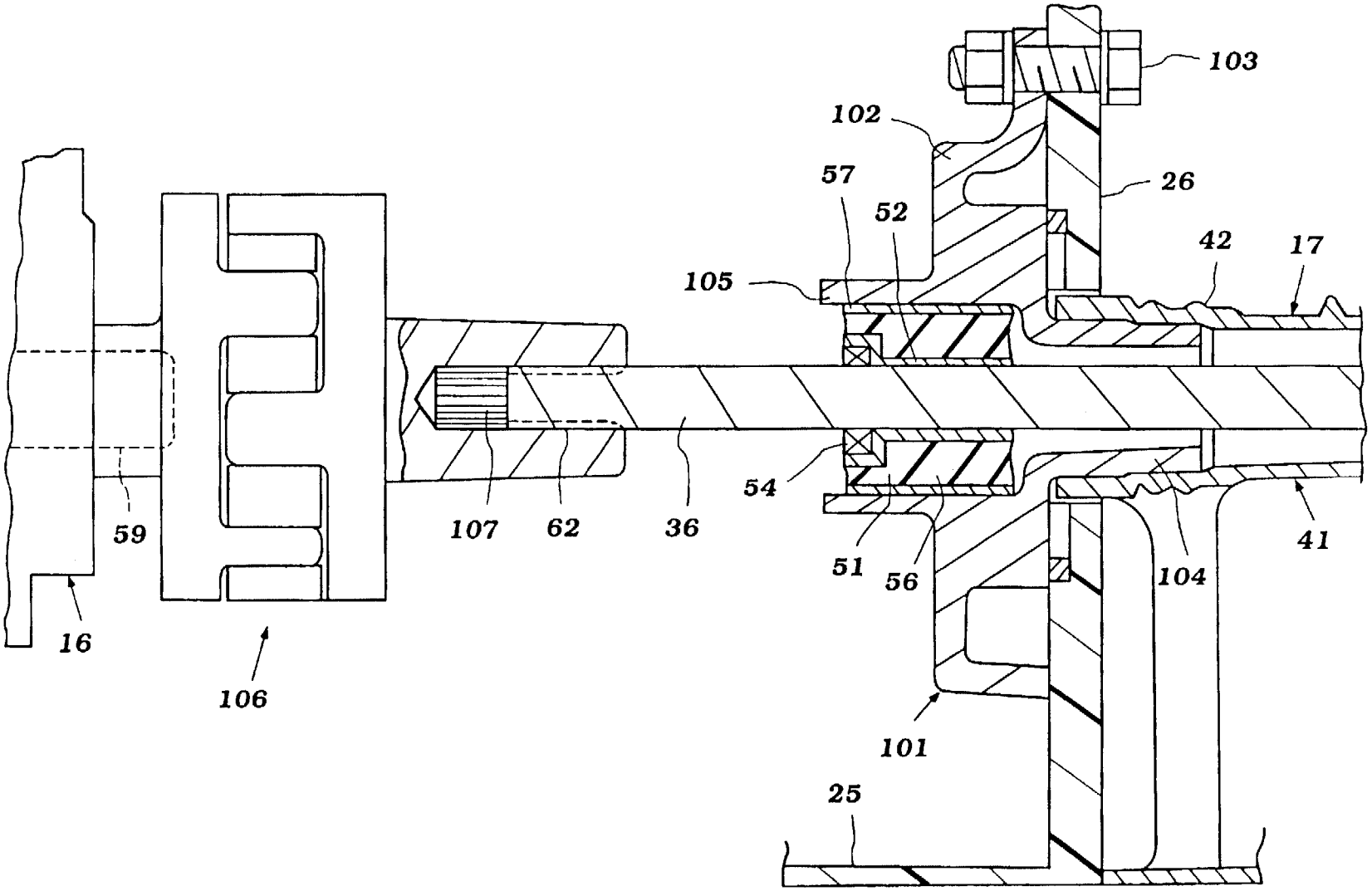
FIG. 6 is a cross-sectional view, in part similar to FIG. 4, and shows another embodiment of the invention.

Another type of elastic plane-bearing support arrangement for the front of the impeller shaft 36 is illustrated in FIG. 6. Because of its similarity to the previously-described embodiment, only a single figure is believed necessary to illustrate this embodiment.

In this embodiment, the bell-mouthed portion 42 of the tubular extension 41 of the jet propulsion unit outer housing extends forwardly and terminates at the bulkhead 26. A supporting diaphragm, indicated generally by the reference numeral 101 has an outer flange portion 102 that is affixed to the bulkhead 26 by threaded fasteners 103. This diaphragm member 101 has a cylindrical extension 104 that is telescopically received within the bell-mouthed portion 41 and thus provides a seal with it.

Forwardly of the bulkhead 26, the diaphragm 101 has cylindrical forwardly extending portion 105 that receives an elastic plane-bearing arrangement, indicated generally by the reference numeral 51 and having the same exact construction as with the embodiment of FIGS. 1–5. For that reason, like components of this elastic plane bearing which includes the bearing sleeve 52 have been identified by the same reference numerals and will not be described again.

Hence, with this arrangement the bearing 51 is interposed directly between the diaphragm member 101 and the forward end of the impeller shaft 36 forwardly of the bulkhead 26 and spaced from the bell-mouthed portion 42 of the jet propulsion unit outer housing tubular extension 41.

In this embodiment, an elastic coupling, indicated generally by the reference numeral 106 has a splined connection to the engine output shaft 59. This portion also provides a female splined opening 107 that receives the male splined end 62 of the impeller shaft 36 for providing the driving connection to the engine 16. Again, it will be readily apparent that this plane-bearing arrangement 51 provides good support for the forward end of the impeller shaft 36 and also permits the impeller shaft to be easily withdrawn along with the jet propulsion unit 17 for servicing as should be readily apparent.

Figure 7:
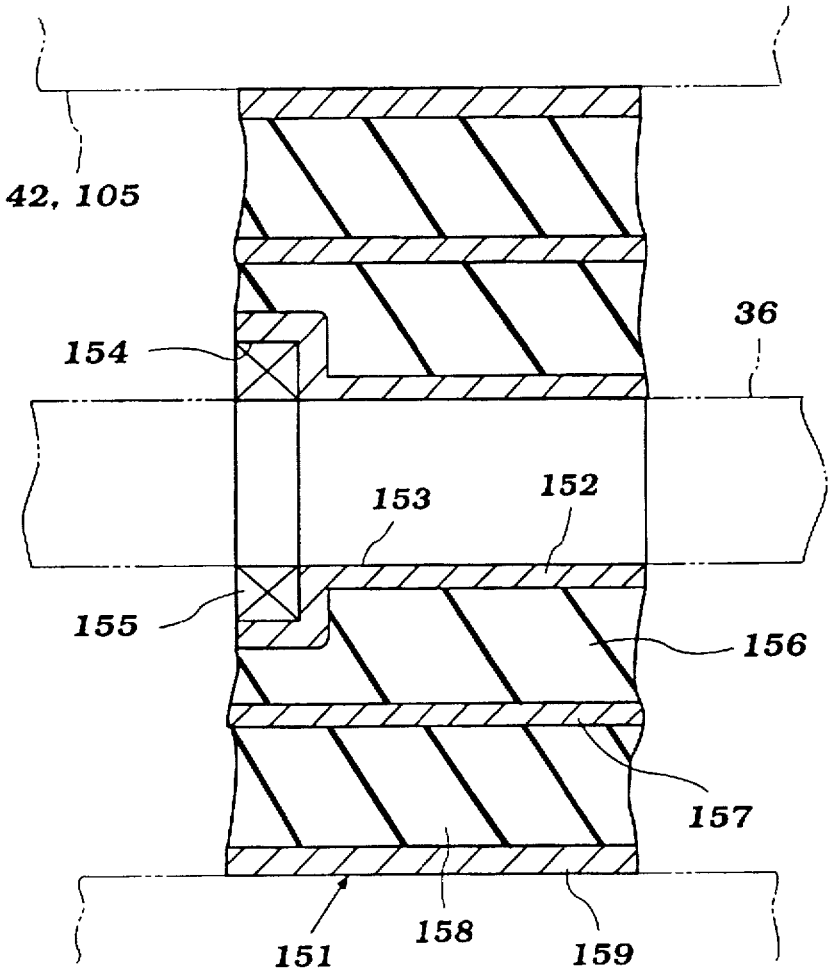
FIG. 7 is an enlarged cross-sectional view taken through the front impeller shaft support of yet another embodiment of the invention.

FIG. 7 illustrates another embodiment of the invention. This embodiment differs from the previously-described embodiments only in the configuration of the elastic plane bearing support for the impeller shaft, which plane bearing support is indicated generally by the reference numeral 151 in this figure. Like the previously described embodiments, this elastic plane-bearing support 151 includes a cylindrical plane bearing portion 152 having an opening 153 that is complementary to the outer diameter of the impeller shaft 36 and through which its splined end 62 may be easily slid. An enlarged portion 154 receives a water seal 155.

A first elastic ring 156 encircles the plane bearing 154 and is bonded or vulcanized to it. An outer metal sleeve 157 receives the outer diameter of the elastic ring 156. A bonded or vulcanized connection may be formed therebetween.

In this embodiment, a second elastic ring 158 encircles and is bonded or vulcanized to the outer surface of the metal ring 156. The ring 158 can have different properties than the elastic ring 156. That is, it may be either more or less resilient so as to provide the desired degree of overall damping.

The outer peripheral edge of the ring 156 is bonded into a further metal ring 159 and this metal ring 159 may be received either in the bell-mouth section 42 of the tubular extension 41 of the jet propulsion unit outer housing as shown in the embodiment of FIGS. 1–5 or in the extending portion 105 of the diaphragm member 101 if utilized with a connection of the type shown in FIG. 6.

Thus, from the foregoing description it should be readily apparent that the described constructions provide a very effective bearing arrangement for the forward end of the impeller shaft and one which permits ease of assembly and disassembly of the impeller shaft from its connection to the drive shaft while minimizing the complexity and construction of the splined connections therebetween. In addition, the plane bearings can have a longer life and less servicing than the anti-friction roller or ball bearings previously employed.

Of course, the foregoing description is that of preferred embodiments of the invention and various changes and modifications may be made without departing from the spirit and scope of the invention, as defined by the appended claims.

What is claimed is:

1. An elastic bearing support for the impeller shaft of a water jet propulsion unit comprised of an outer housing having a tubular extension through which an impeller shaft extends, a plane bearing having a slidable support with the forward end of said impeller shaft, an elastomeric element directly affixed to said plane bearing and tubular housing for accommodating transverse movement of said plane bearing relative to said tubular extension, and a seal received in an integral cavity formed at one end of said plane bearing in sealing engagement with said impeller shaft.

2. An elastic bearing support for the impeller shaft of a water jet propulsion unit as set forth in claim 1, wherein the tubular extension is formed as an extension of the jet propulsion unit outer housing.

3. An elastic bearing support for the impeller shaft of a water jet propulsion unit as set forth in claim 2, wherein the tubular extension is formed by a diaphragm member affixed to a bulkhead formed at one end of a tunnel in which the jet propulsion unit is received.

4. An elastic bearing support for the impeller shaft of a water jet propulsion unit as set forth in claim 1, wherein elastic element comprises concentric first and second elastomeric rings with a metal sleeve being bonded between said rings.

* * * * *